US006523923B2

(12) United States Patent
Sekiguchi

(10) Patent No.: US 6,523,923 B2
(45) Date of Patent: Feb. 25, 2003

(54) WAVEFROM PREVENTS INK DROPLETS FROM COALESCING

(75) Inventor: Yasuhiro Sekiguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/977,302

(22) Filed: Oct. 16, 2001

(65) Prior Publication Data

US 2002/0080202 A1 Jun. 27, 2002

(30) Foreign Application Priority Data

Oct. 16, 2000 (JP) ..... 2000-315265
Aug. 27, 2001 (JP) ..... 2001-255643

(51) Int. Cl.[7] ..... B41J 29/38
(52) U.S. Cl. ..... 347/11; 347/10
(58) Field of Search ..... 347/9, 10, 11

(56) References Cited

U.S. PATENT DOCUMENTS 5,600,349 A * 2/1997 Keefe ..... 347/11
5,736,995 A * 4/1998 Bohorquez et al. ..... 347/14
5,917,509 A * 6/1999 Becerra et al. ..... 347/11
6,022,092 A * 2/2000 Misumi ..... 347/10
6,099,103 A * 8/2000 Takahashi ..... 347/11
6,141,113 A * 10/2000 Takahashi ..... 358/1.8
6,145,949 A * 11/2000 Takahashi ..... 347/14
6,257,685 B1 * 7/2001 Ishikawa ..... 347/10
6,260,959 B1 * 7/2001 Takahashi ..... 347/68
6,416,149 B2 * 7/2002 Takahashi ..... 347/10
6,419,336 B1 * 7/2002 Takahashi ..... 347/10
6,419,337 B2 * 7/2002 Sayama ..... 347/11
2002/0089575 A1 * 7/2002 Takahashi ..... 347/71

FOREIGN PATENT DOCUMENTS

JP 10-296975 A 11/1998

* cited by examiner

*Primary Examiner*—John Barlow
*Assistant Examiner*—Lam Nguyen
(74) *Attorney, Agent, or Firm*—Oliff & Berridge, PLC

(57) ABSTRACT

In a drive signal where three ink droplets are ejected for one printing command, the following expressions are satisfied: $0.8T \leqq T1 \leqq 1.2T$, $0.4T \leqq T2 \leqq 1.2T$, $0.4T \leqq T3 \leqq 0.8T$, $W1 > W2$, $W1 > 2T$, wherein T1, T2, T3 are pulse widths for drive pulses P1, P2, P3 each to eject an ink droplet and W1, W2 are pulse intervals. When the drive signal meeting the above conditions is applied to an actuator for a printing operation, ink droplets can be ejected stably over a wide range of temperatures without dispersion in density and can be prevented from coalescing into one globule along the trajectory.

17 Claims, 12 Drawing Sheets

WAVEFROM PREVENTS INK DROPLETS FROM COALESCING

BACKGROUND OF THE INVENTION

1. Field of Invention

The invention relates to an ink ejection apparatus that ejects ink droplets from a nozzle by driving an actuator to generate a pressure wave in an ink chamber, particularly to an ink ejection apparatus capable of ejecting three or more ink droplets for one printing command.

2. Description of Related Art

Non-impact type printing devices have recently taken the place of conventional impact type printing devices and are holding an ever-growing share of the market. Of these non-impact type printing devices, ink jet type printing devices have the simplest operation principle, but are still capable of effectively and easily performing multi-gradation and color printing. Of these devices, a drop-on demand type that ejects ink droplets only used for printing has rapidly gained popularity because of its excellent ejection efficiency and low running cost.

A conventional ink ejection apparatus used in a drop-on demand type printing device includes a nozzle from which ink is ejected, an ink chamber that is provided on the back of the nozzle and stores ink, an actuator that changes the volume of the ink chamber, and a driving device that drives the actuator to generate pressure wave vibrations in the ink chamber causing ink to be ejected from the nozzle. This kind of ink ejection apparatus is of a design wherein the driving device drives the actuator to generate the pressure wave vibrations in the ink chamber in response to a change in the volume of the ink chamber, thereby ejecting ink from the nozzle.

The actuator may be made of a piezoelectric element that deforms through the application of a drive voltage. In this case, ink is ejected by applying a pulse voltage (hereinafter referred to as a drive pulse) to the piezoelectric elements from a drive circuit. In this kind of ink ejection apparatus, it is conceivable that the drive pulse is repeatedly applied to the actuator in response to one print command, to eject multiple ink droplets from one nozzle, so that one dot is formed. As one dot is produced from large quantity of ink in this case, an image can be formed having a deep color.

There is a shear mode type of piezoelectric element in an ink ejection apparatus using the piezoelectric element as the actuator, for example. An exemplary ink ejection apparatus of this kind, which also is the apparatus to which the invention is applied, is shown in FIGS. 10A and 10B. FIG. 10A is a sectional view taken along line 10—10 of FIG. 10B. FIG. 10B is a sectional view taken along line 11—11 of FIG. 10A.

As shown in FIG. 10A, an ink ejection apparatus 600 includes a bottom wall 601, a top wall 602, and elongated shear mode actuator walls 603 sandwiched therebetween. Each actuator wall 603 includes an upper wall 605 of piezoelectric material, which is adhesively attached to the top wall 602 and polarized in a direction indicated by an arrow 609, and a lower wall 607 of piezoelectric material, which is adhesively attached to the bottom wall 601 and polarized in a direction indicated by an arrow 611. Alternating pairs of actuator walls 603 form in alternation between ink chambers 613 and spaces 615, the spaces 615 narrower than the ink chambers 613.

As shown in FIG. 10B, a nozzle plate 617 having nozzles 618 is fixedly secured to one end of each ink chamber 613 and an ink supply source (not shown) is connected to the other end of each ink chamber 613 via a manifold 626. The manifold 626 includes a front wall 627 formed with openings in positions corresponding to the ink chambers 613, a rear wall 628 for sealing the space between the bottom wall 601 and the top wall 602. The manifold 626 is structured to distribute the ink supplied from the ink supply source to the front wall 627 and the rear wall 628 into each of the ink chambers 613.

Electrodes 619, 621 are provided on both sides of each of the actuator walls 603. Specifically, the electrode 619 is provided on the actuator wall 603 in the ink chamber 613 and the electrode 621 is provided on the actuator wall 603 in the space 615. The electrode 621 is also provided on the outer side surface of each of the two outermost actuator walls 603. The electrode 619 is covered by an insulating layer (not shown) to insulate it from the ink. Each electrode 621 is connected to a ground 623. Each electrode 619 provided in the ink chamber 613 is connected to a control unit 625 and carries a voltage (drive signal) described later.

When the control unit 625 applies the voltage to the electrodes 619 in the ink chambers 613, pairs of the actuator walls 603 deform in the shear mode such that the volume of each ink chamber 613 increases. An example of this operation is shown in FIG. 11. When a voltage of E volts, which is the crest value, is applied to an electrode 619*c* of the ink chamber 613*c*, an electric field develops in each of the actuator walls 603*e* and 603*f* in the directions indicated by the arrows 631 and 632, respectively. The actuator walls 603*e* and 603*f* deform in the shear mode to increase the volume of the ink chamber 613*c*. At this time, the pressure in the ink chamber 613*c* including the nozzle 618*c* decreases.

The voltage of E volts is applied to the electrode 619 only for a one-way propagation time T. While the voltage is applied, ink is supplied from the ink supply source. The one-way propagation time T is a time required for a pressure wave in the ink chamber 613 to propagate once in the lengthwise direction of the ink chamber 613. The one-way propagation time T is calculated by the following expression:

$$T=L/a,$$

wherein L is the length of the ink chamber 613 and a is the speed of sound in the ink in the ink chamber 613.

According to the theory of pressure wave propagation, the pressure in the ink chamber 613 reverses into a positive pressure when the one-way propagation time T passes after the application of the voltage. When the pressure becomes positive, the control unit 625 returns the voltage applied to the electrode 619 of the ink chamber 613 to zero volts, so that the deformed actuator walls 603*e* and 603*f* revert to their initial shape, as shown in FIG. 10A, and pressure is applied to the ink. The pressure reverted to positive and the pressure generated when the deformed actuator walls 603*e* and 613*f* return to their initial shape are combined into a relatively high pressure that develops near the nozzle 618*c* in the ink chamber 613*c*, ejecting ink from the nozzle 618*c*.

However, when three or more ink droplets are ejected for one printing command in a drive waveform, as shown in FIG. 8E, the drive pulses are set as follows:

$$T1=T2=T3=T,$$

$$W1=W2=2T,$$

wherein T is the one-way propagation time, T1 is a pulse width of a drive pulse P1 for ejecting a first ink droplet, T2 is a pulse width of a drive pulse P2 for ejecting a second ink droplet, T3 is a pulse width of a drive pulse P3 for ejecting a third ink droplet, W1 is an interval between the drive pulses P1 and P2, and W2 is an interval between the drive pulses P2 and P3.

In this case, the application of the pressure to the ink chamber and the cancellation of the pressure application are performed in synchronization with the one-way propagation time T. In other words, the pressure is applied in accordance with a rising point of the ink pressure wave and the application of the pressure is cancelled in accordance with a falling point of the ink pressure wave. Therefore, the pressure wave is gradually amplified to perform efficient ink ejection. However, the pressure applied to the ink becomes greater whenever the ink droplet is ejected, and ejecting speed becomes faster for a later ink droplet. As a result of the influence of the pressure wave, the ink may be ejected from an adjacent nozzle, ink ejection may become unstable and the interval to eject ink droplets may become short when the printing command is continuously executed on the same nozzle. As shown in FIG. 9B, ink droplets 99 may coalesce into one along the trajectory. If the ink droplets 99 coalesce or unify, during the trajectory in this manner, deviation in trajectory occurs, lowering printing quality. Further, when the temperature of the ink is changed, the one-way propagation time T is also changed, becoming out of synch with the application of the ink pressure wave and the cancellation of the application. As a result, ink droplets vary in size, printing density is changed, and ink ejection becomes unstable.

SUMMARY OF THE INVENTION

The invention provides an ink ejection apparatus capable of ejecting three or more ink droplets for one printing command stably without dispersion in density over a wide range of temperatures and of preventing ink droplets from coalescing into a globule during the trajectory without difficulty to improve printing quality.

According to one aspect of the invention, an ink ejection apparatus includes a nozzle from which ink is ejected, an ink chamber provided on a back of the nozzle where the ink is stored, an actuator that changes a volume of the ink chamber, and a drive device that drives the actuator by applying a drive signal including a plurality of pulses to the actuator to cause the actuator to generate a pressure wave vibration in the ink chamber, thereby ejecting the ink from the nozzle. The drive device generates positive and negative pressure waves in the ink chamber through application of one drive pulse to the actuator. When three or more ink droplets are ejected for one printing command, the drive signal satisfies the following expressions:

$$0.8T \leqq T1 \leqq 1.2T,\ 0.4T \leqq T2 \leqq 1.2T,\ 0.4T \leqq T3 \leqq 0.8T,\ W1 > W2,\ W1 > 2T,$$

wherein T1 is an effective pulse width of a drive pulse P1 to eject a first ink droplet, T2 is an effective pulse width of a drive pulse P2 to eject a second ink droplet, T3 is an effective pulse width of a drive pulse P3 to eject a third ink droplet, W1 is an interval between the drive pulses P1 and P2, W2 is an interval between the drive pulses P2 and P3, and T is a one-way propagation speed where a pressure wave is propagated in the ink chamber once.

Under these expressions, as T3 is set shorter than T and W1 is set longer than 2T, the first ink droplet ejection does not have an adverse effect upon the second and third ink droplets, thereby reducing the pressure applied to the ink during the ejection of the second and third ink droplets. This enables ink droplets to be ejected stably and separately thereby preventing the ink droplets from coalescing into one globule. The nozzle is not affected by the previous ink ejection and ink ejection by an adjacent nozzle, thereby improving printing quality. As there is no need to insert a non-ejection pulse between the drive pulses, as has been conventional, the invention can preferably correspond to high-speed printing. The ink droplets can be stably ejected over a wide range of temperatures, thereby stably obtaining a specific printing density.

In the above structure, it is preferable that T2, T3, W1, and W2 further satisfy the following expressions:

$$0.4T \leqq T2 = T3 \leqq 0.8T,\ 1.8T \leqq W2 \leqq 2.2T, \text{ and } 2.2T \leqq W1 \leqq 2.8T.$$

It has been found from various experiments that printing quality can be improved further preferably and stably when T2, T3, W1 and W2 satisfy the above expressions.

Further, it is preferable that T1, T2 and T3 satisfy the following expression:

$$T1 \geqq T2 > T3.$$

It has been found from various experiments that ink droplets can be further preferably ejected over a wide range of temperatures and a specific printing density can be stably obtained when T1, T2 and T3 satisfy the above expression.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

Figure 1:
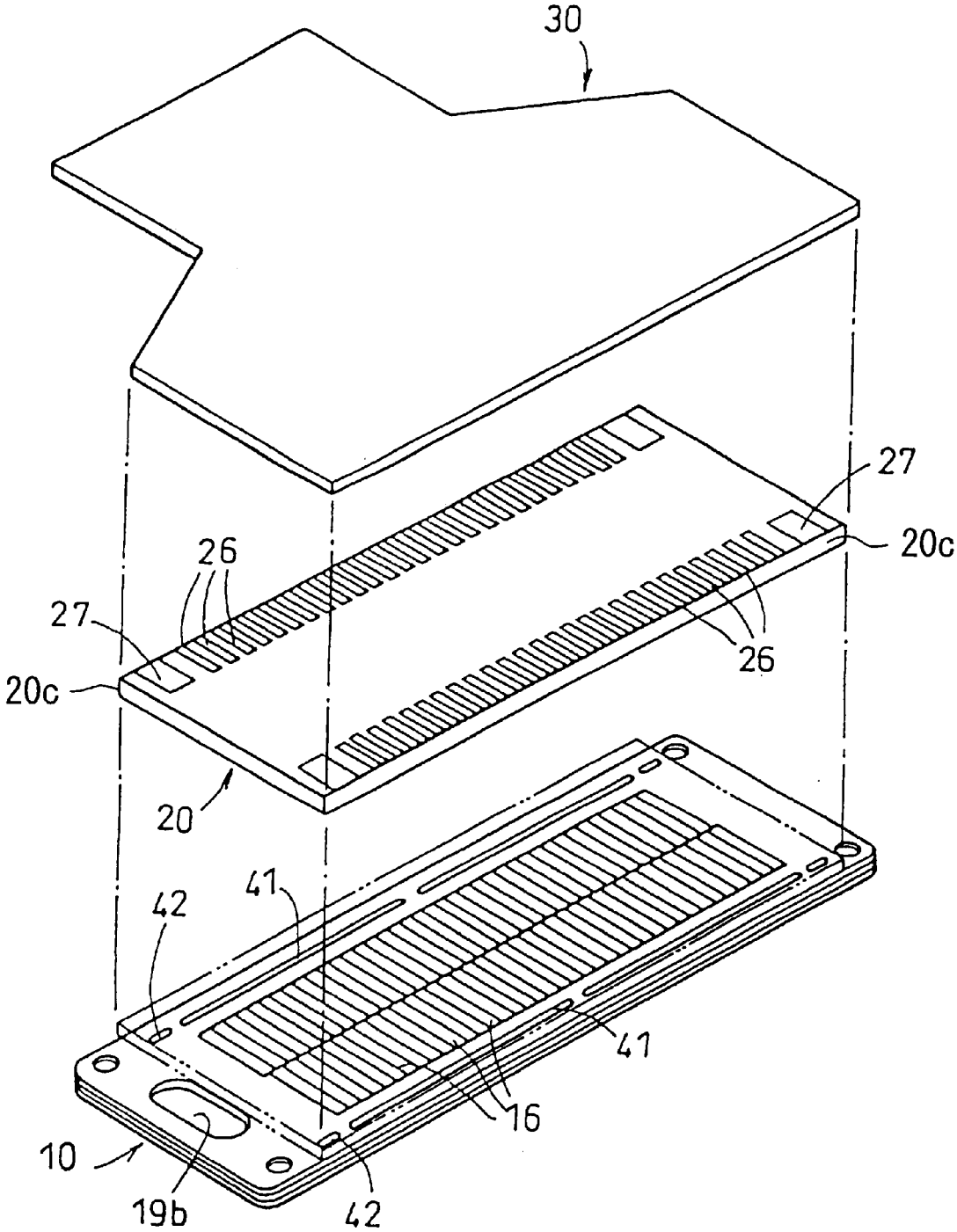
FIG. 1 is an exploded perspective view of an ink jet printer head as one embodiment of an ink ejection apparatus.

As shown in FIG. 1, the ink jet printer head is formed by laminating a cavity plate 10 made of metal, a piezoelectric actuator 20 and a flexible, flat connecting cable 30. The connecting cable 30 goes to external equipment.

Figure 2:
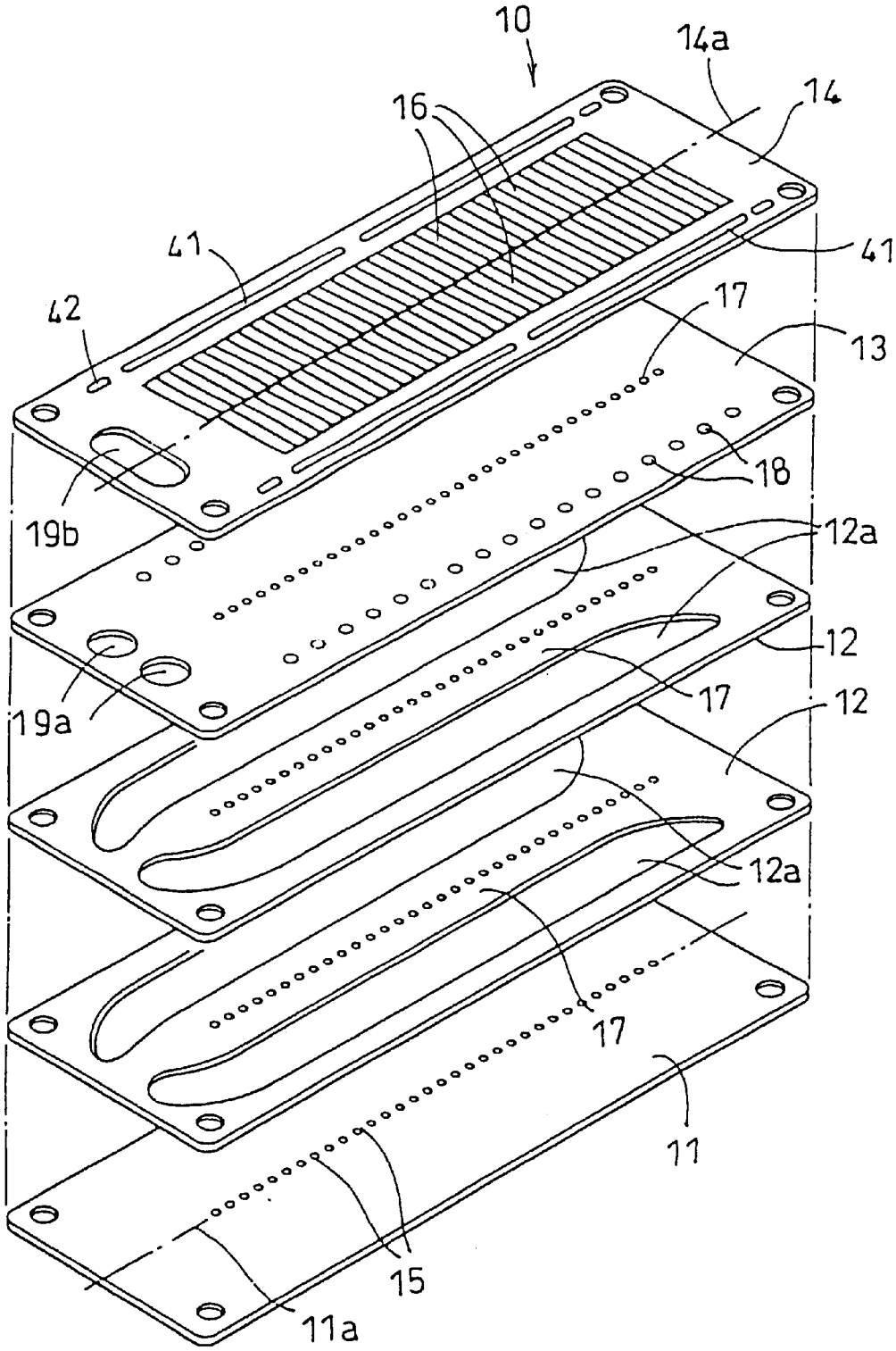
FIG. 2 is an exploded perspective view of a cavity plate of the ink jet printer head.

The cavity plate 10 (FIG. 2) is made up of five thin metal plates of substantially rectangular shape; a nozzle plate 11, two manifold plates 12, a spacer plate 13, and a base plate 14.

The nozzle plate 11 has a line of nozzles 15 of minute diameter for ejecting ink droplets, which are provided lengthwise along the centerline 11*a* at a micro pitch. The manifold plates 12 each have ink passages 12*a* that extend along both sides of the line of nozzles 15. The ink passages 12*a* are defined by sandwiching the manifold plates 12 between the nozzle plate 11 and the spacer plate 13.

Figure 3:
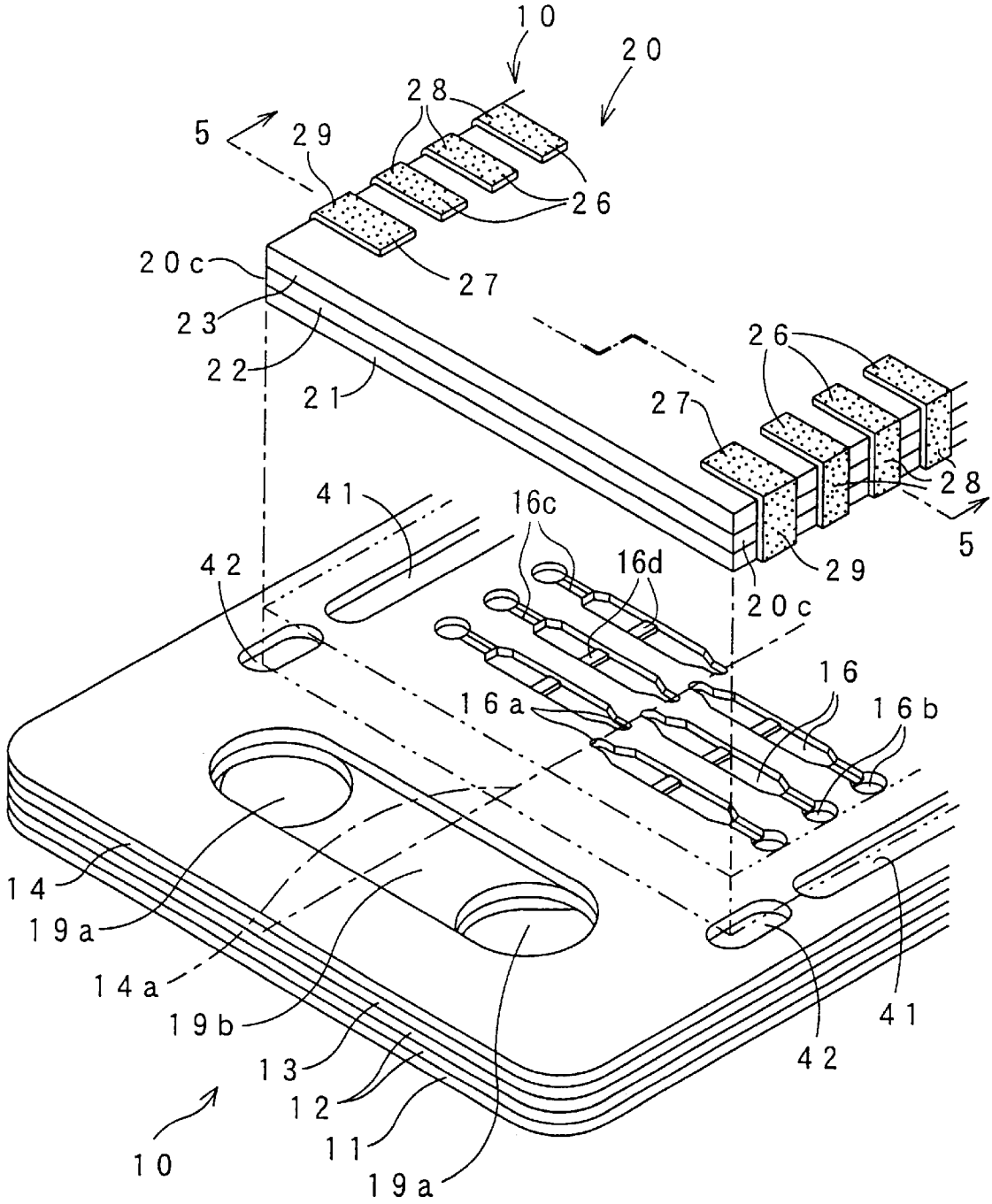
FIG. 3 is an enlarged perspective view of a main structure of the cavity plate.
Figure 4:
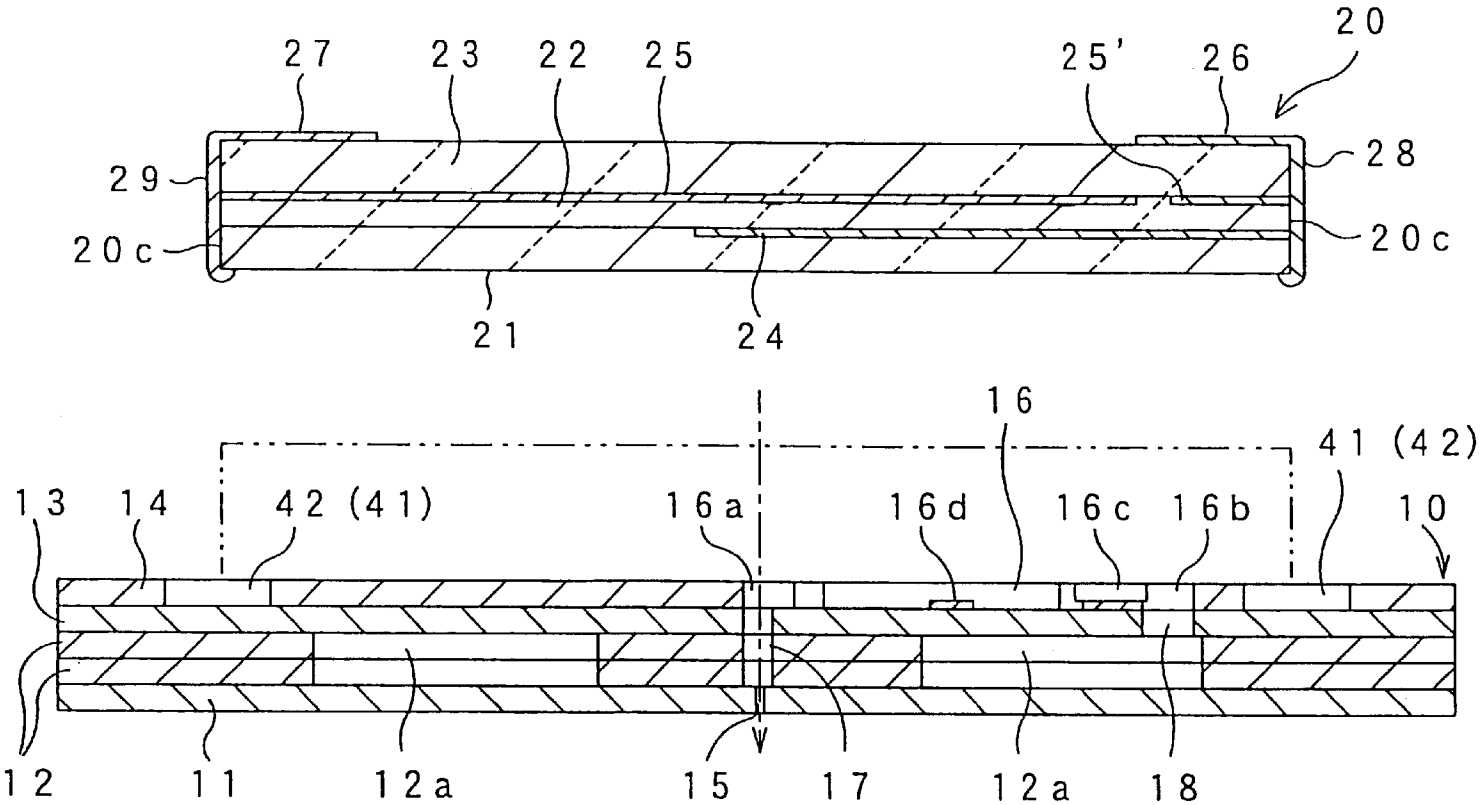
FIG. 4 is a sectional view showing the structure of the cavity plate taken along line 5—5 of FIG. 3.

The base plate 14 has a number of narrow ink chambers 16 each of which extends in a direction orthogonal to a centerline 14*a* along the length of the base plate 14. As shown in FIGS. 3 and 4, ink outlets 16*a* of the ink chambers 16 are positioned on the centerline 14*a* in such a manner that alternate ink chambers 16 extend from the ink outlets 16*a* in direction opposite to each other. The ink outlets 16*a* of the ink chambers 16 communicate with the nozzles 15 in the nozzle plate 11 via through holes 17 provided in both the spacer plate 13 and the manifold plates 12. The ink inlets 16*b* of the ink chambers 16 communicate with the corresponding ink passages 12*a* through holes 18 provided in the spacer plate 13.

With this structure, the ink fed from supply holes 19*a*, 19*b* provided on one side of both the spacer plate 13 and the base plate 14 flows to the ink passages 12*a*, and passes through each of the through holes 18, thereby to be directed to each of the ink chambers 16. After that, the ink passes through each of the through holes 17 aligned with each of the ink outlets 16*a* of the ink chambers 16 and reaches an associated one of the nozzles 15. Each of the ink chambers 16 has a narrow groove 16*c* adjacent to the ink inlet 16*b* and a beam 16*d* for reinforcement in a central portion. The narrow groove 16*c* and the beam 16*d* are partially thinned and integrally formed in the ink chamber 16.

Figure 5:
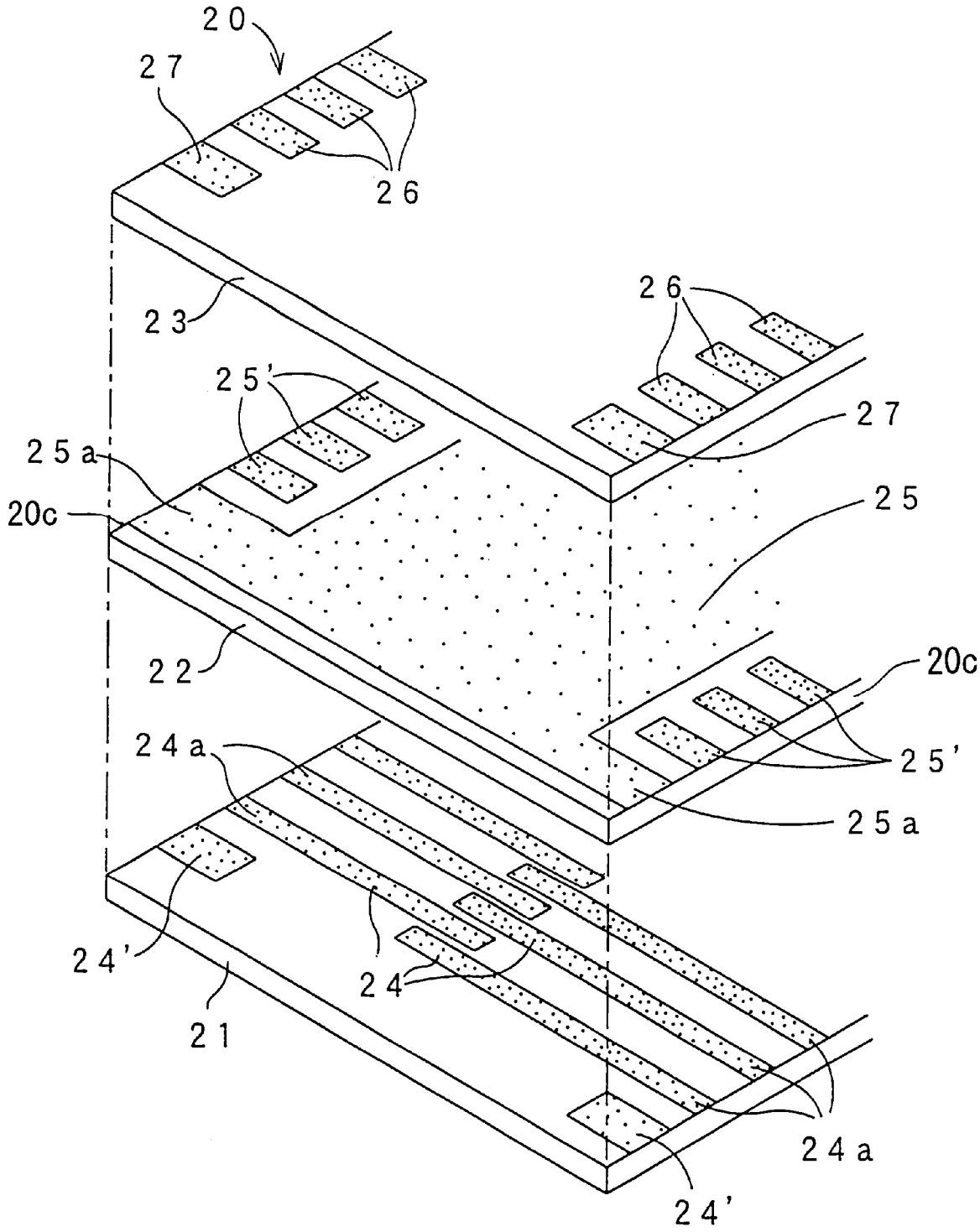
FIG. 5 is an exploded perspective view of a piezoelectric actuator of the ink jet printer head.

As shown in FIG. 5, the piezoelectric actuator 20 is constructed by laminating three piezoelectric sheets 21, 22, 23. Narrow drive electrodes 24 are formed on the upper surface of the lowermost piezoelectric sheet 21 (closest to the cavity plate 10) so as to be aligned with the respective ink chambers 16 in the cavity plate 10. In addition, the drive electrodes 24 are formed in such a manner that one end 24*a* of each of the drive electrodes 24 is bare on either of right and left side surfaces 20*c* (FIG. 3) in the direction of the length of the piezoelectric actuator 20.

A common electrode 25 is formed on the upper surface of the middle piezoelectric sheet 22 so that projecting parts 25*a* of the common electrode 25 extend out to the right and left side surfaces 20*c*. Further, surface electrodes 26 facing the respective drive electrodes 24 and surface electrodes 27 facing projecting parts 25*a* of the common electrode 25 are provided on the upper surface of the uppermost piezoelectric sheet 23, so as to be arranged along the right and left side surfaces 20*c*. The numerals 24' and 25' indicate electrodes for dummy patterns.

In FIGS. 3 and 4, side-mounted electrodes 28, that electrically connect the drive electrodes 24 and the respective surface electrodes 26, and side-mounted electrodes 29, that electronically connect the projecting parts 25*a* of the common electrode 25 and the surface electrodes 27, are formed at the side surfaces 20*c*. In the above description, the piezoelectric sheet 21 on which the drive electrodes 24 are formed and the piezoelectric sheet 22 on which the common electrode 25 is formed are laminated only in one pair, however, they may be laminated in a plurality of pairs.

The piezoelectric actuator 20 structured in this manner is fixedly laminated to the cavity plate 10. The lamination is made to block each ink chamber 16 on the underside of the piezoelectric sheet 21 mounting the drive electrodes 24 thereon. Further, the flexible flat cable 30 is fixedly laminated onto the piezoelectric actuator 20 so that a printed pattern (not shown) exposed at the underside of the flat cable 30 can be electrically connected to the surface electrodes 26, 27.

In the ink jet printer head, when a voltage is applied between one of the drive electrodes 24 and the common electrode 25 in the piezoelectric actuator 20, the piezoelectric sheet 22 sandwiched between the drive electrode 24 and the common electrode 25 deforms by piezoelectric effect in a direction where the sheets are laminated. By this deformation, the volume of the ink chamber 16 corresponding to the drive electrode 24 is reduced, causing ink stored in the ink chamber 16 to be ejected as a droplet from the associated nozzle 15. Alternatively, the drive voltage can be applied to all drive electrodes 24 in advance before an ejection command is input, to cause the piezoelectric sheet 22 to deform in relation to all ink chambers 16. In this case, when the ejection command is input to one of the drive electrodes 24, the voltage application to the drive electrode 24 is cancelled and the volume of the corresponding ink chamber 16 is increased. Then when the voltage is again applied to the drive electrode 24, the piezoelectric sheet 22 aligned with the ink chamber 16 is returned to the deformed state and the pressure is applied to the ink chamber 16. This causes ink stored in the ink chamber 16 to be ejected as a droplet from the associated nozzle 15.

Figure 6:
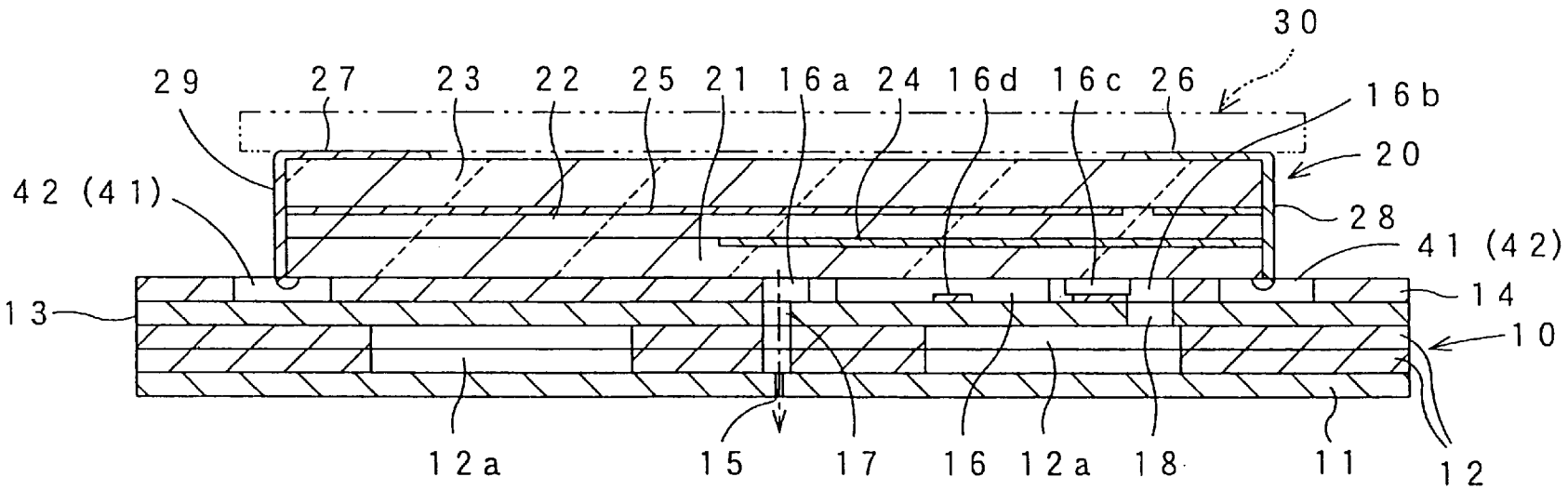
FIG. 6 is a sectional view taken along line 5—5 of FIG. 3 when the piezoelectric actuator is mounted on the cavity plate.

In the ink jetprinterhead of this embodiment, holes 41, 42 are opened in the base plate 14 so as to be aligned with the side-mounted electrodes 28, 29. This can preferably prevent a short circuit between the side-mounted electrodes 28, 29 and the base plate 14 when the piezoelectric actuator 20 is placed on the cavity plate 10, as shown in FIG. 6.

Figure 7:
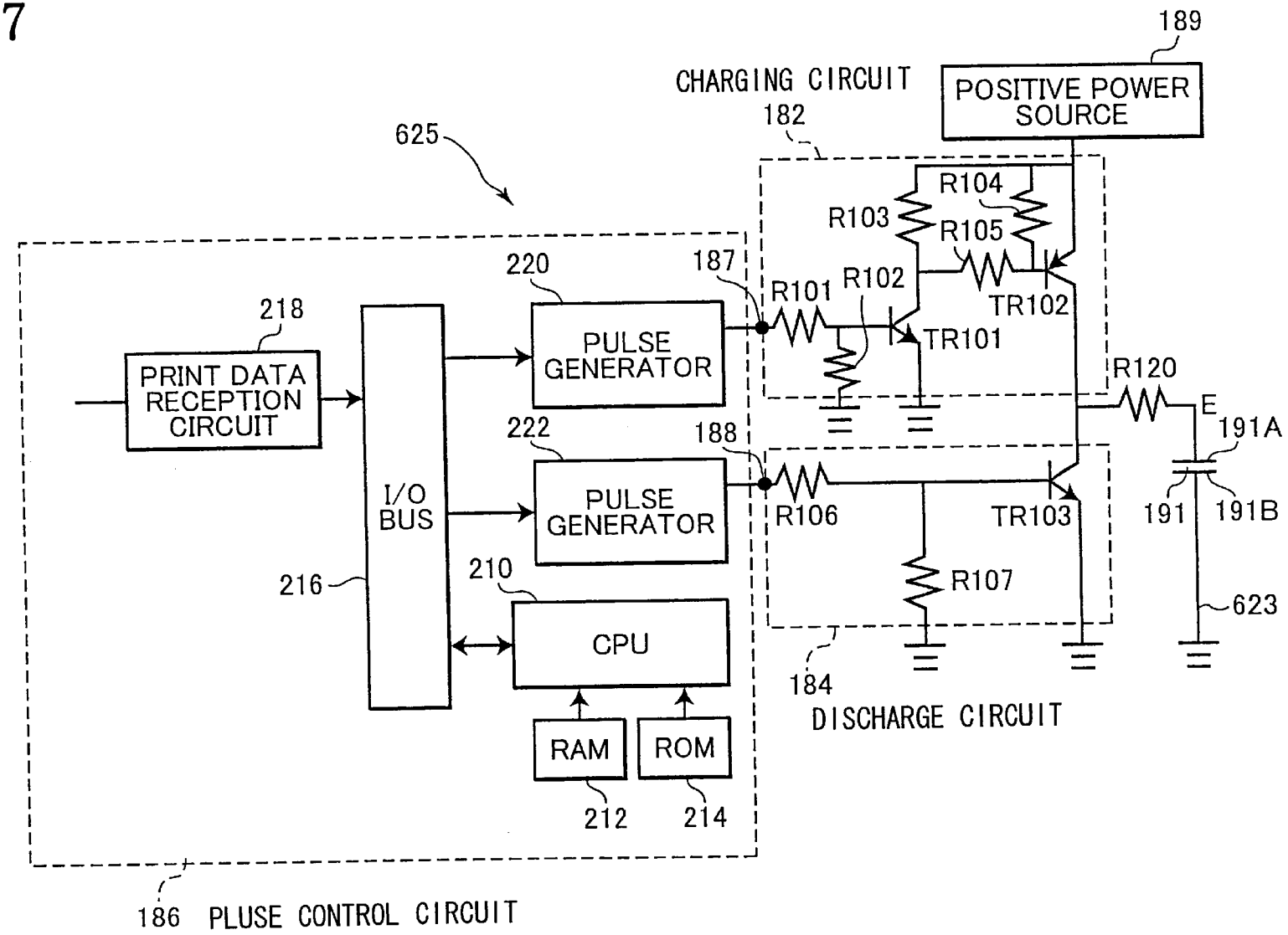
FIG. 7 is a circuit diagram of a drive circuit used in the ink jet printer head.

In this embodiment, to apply the drive voltage to the drive electrodes 24, a drive circuit 100 is connected to the surface electrodes 26, 27 on the piezoelectric actuator 20 via the flexible flat cable 30. FIG. 7 is a circuit diagram showing the configuration of the drive circuit 100 in the ink jet printer head.

As shown in FIG. 7, the drive circuit 100 includes a charging circuit 182, a discharge circuit 184, and a pulse control circuit 186. In addition, the piezoelectric sheet 22, the drive electrodes 24, and the common electrode 25 are equivalently represented by a capacitor 191. Terminals 191A, 191B of the capacitor 191 correspond to the drive electrodes 24 and the common electrode 25, respectively. The terminal 191A is connected to the drive circuit 100 and the terminal 191B is connected to a ground 623.

An input terminal 187 provided in the charging circuit 182 and an input terminal 188 provided in the discharge circuit 184 are terminals to input a signal for applying the drive voltage of E volts (e.g. 20V) or 0V to the terminal 191A (the drive electrode 24 of the associated ink chamber 16) from the pulse control circuit 186.

The charging circuit 182 includes resistors R101, R102, R103, R104 and R105, and transistors TR101 and TR102. A base of the transistor TR101 is connected to the input terminal 187 via the resistor R101 and is grounded via the resistor R102. An emitter of the transistor TR101 is directly grounded and a collector thereof is connected to a positive power supply 189 of E volts via the resistor R103. A base of the transistor TR102 is connected to the positive power supply 189 via the resistor R104 and to the collector of the transistor TR101 via the resistor R105. An emitter of the transistor TR102 is connected directly to the positive power supply 189 and a collector thereof is connected to the terminal 191A via the resistor R120.

When an ON signal (+5V) is applied to the input terminal 187, the transistor TR101 becomes conductive, allowing current from the positive power supply 189 to flow from the collector of the transistor TR101 to the emitter. This raises the voltage dividedly applied to the resistors R104, R105, connected to the positive power supply 189, and increases the current flowing to the base of the transistor TR102, making the transistor TR102 conductive between the emitter and the collector of the transistor TR102. As a result, the voltage of E volts is applied from the positive power supply 189 to the terminal 191A (that is, the drive electrodes 24) of the capacitor 191 via the collector and the emitter of the transistor TR102 and the resistor R120.

The discharge circuit 184 includes resistors R106, R107 and transistor TR103. A base of the transistor TR103 is connected to the input terminal 188 via the resistor R106 and grounded via the resistor R107. An emitter of the transistor TR103 is directly grounded and a collector thereof is connected to the terminal 191A via the resistor R120. As a result, when an ON signal (+5V) is applied to the input terminal 188, the transistor TR103 becomes conductive, allowing the terminal 191A (that is, the drive electrodes 24) of the capacitor 191 to ground via the resistor R120.

When an ON signal is applied to the input terminal 187 from the pulse control circuit 186 and an OFF signal is applied to the input terminal 188, the drive voltage of E volts can be applied to the drive electrode 24. When an OFF signal is applied to the input terminal 187 from the pulse control circuit 186 and an ON signal is applied to the input terminal 188, the drive electrode 24 can be maintained at 0 volts as with the common electrode 25.

The variations in voltage applied to the drive electrode 24 via the charging circuit 182 and the discharge circuit 184 actually include a delay corresponding to the capacitance of the piezoelectric sheet 22. However, the following description will be made on the assumption that variations in signal to be input to the input terminals 187, 188 are synchronized with the variations in voltage to be applied to the drive electrode 24.

The pulse control circuit 186 includes a CPU 210 that performs various calculations, which is connected to a RAM 212 and a ROM 214. The RAM 212 stores print data and other data in it. The ROM 214 stores the control programs for the pulse control circuit 186 and sequence data for generating ON and OFF signals of the waveforms shown in FIGS. 8A to 8D.

In addition, the CPU 210 is connected to an I/O bus 216 via which various data can be input and output. The I/O bus 216 is connected to a print data receiving circuit 218 and pulse generators 220, 222. An output from the pulse generator 220 is input to the input terminal 187 of the charging circuit 182 and an output from the pulse generator 222 is input to the input terminal 188 of the discharge circuit 184.

In the pulse control circuit 186 configured above, the CPU 210 controls the pulse generators 220, 222 in accordance with the sequence data stored in the ROM 214 to apply the drive voltage to the appropriate drive electrode 24 in a timed relationship associated with the sequence data. Pulse generators 220, 222, the charging circuit 182 and the discharge circuit 184 are provided for each nozzle 15 of the ink jet printer head. The CPU 210 outputs a drive signal to a drive electrode 24 associated with the print data, causing the ink to be ejected from the corresponding nozzle 15.

Figure 8A:
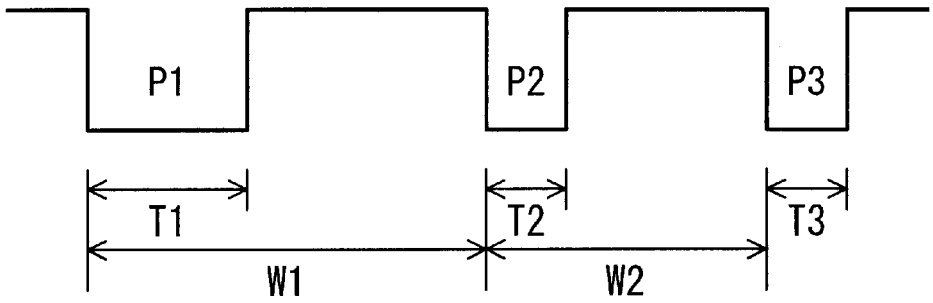
FIG. 8A is a drive voltage waveform of a drive voltage applied to the piezoelectric actuator.

An exemplary waveform of the above drive signal (hereinafter referred to as a drive waveform) in the drive circuit 100 is shown in FIG. 8A. The drive circuit 100 outputs the drive signal while the ink jet printer head is moved by the carriage. The drive waveform shown in FIG. 8A represents a case where three ink droplets are ejected for one printing command. T1 is an effective pulse width of a drive pulse P1 for ejecting a first ink droplet. T2 is an effective pulse width of a drive pulse P2 for ejecting a second ink droplet. T3 is an effective pulse width of a drive pulse P3 for ejecting a third ink droplet. W1 is an interval between the drive pulses P1, P2. W2 is an interval between the drive pulses P2, P3.

With this drive signal, the voltage of E volts is applied under normal circumferences, and stopped (0 volts) and applied again in timed relationship among the drive pulses P1, P2 and P3. Accordingly, the piezoelectric actuator 20 is normally deformed in a direction causing the volume of each of the ink chambers 16 to shrink. The deformation of the piezoelectric actuator 20 is stopped when the voltage application is canceled at each drive pulse, which enlarges the volume of the corresponding ink chamber 16. Then, when the voltage is applied again, the piezoelectric actuator 20 is returned to the deformed state in the direction causing the volume of the ink chamber 16 to shrink, providing ink in the ink chamber 16 with an ejection pressure.

It is found that ink droplets 99 can be prevented from coalescing into a globule (FIG. 9A) easily and stably, without a need to insert a non-ejection pulse between the drive pulses as has been conventional, when the drive signal satisfies the following expressions:

$$0.8T \leqq T1 \leqq 1.2T,\ 0.4T \leqq T2 \leqq 1.2T,\ 0.4T \leqq T3 \leqq 0.8T,\ W1 > W2,\ W1 > 2T,$$

where T is a one-way propagation time where the pressure wave of the ink propagates through the ink chamber 16.

It is believed that, as T3 is set shorter than T and W1 is set longer than 2T, the first ink droplet ejection can not have any adverse effect upon the second and third ink droplets, thereby reducing the pressure applied to the ink during the ejection of the second and third ink droplets.

Figure 9A:
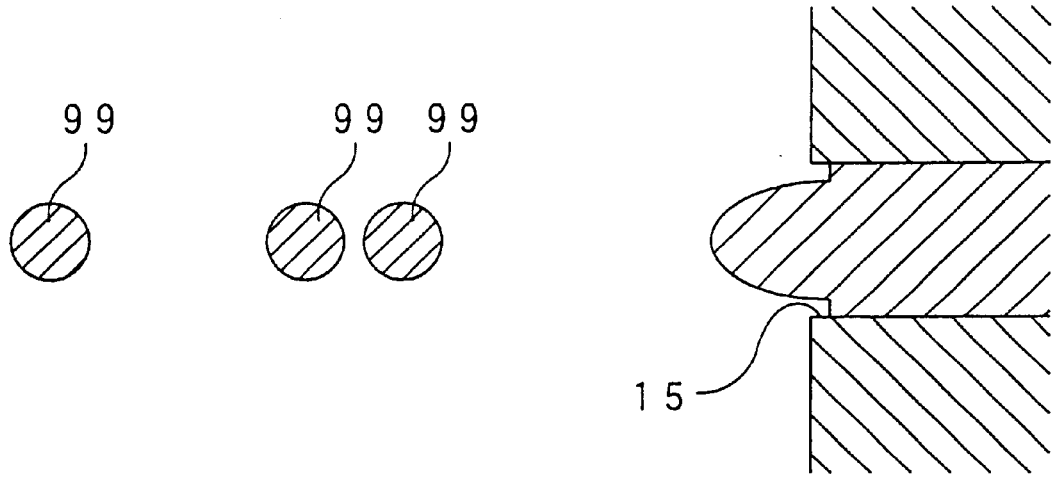
FIG. 9A shows ink ejection when the drive voltage waveform of the embodiment is applied.
Figure 9B:
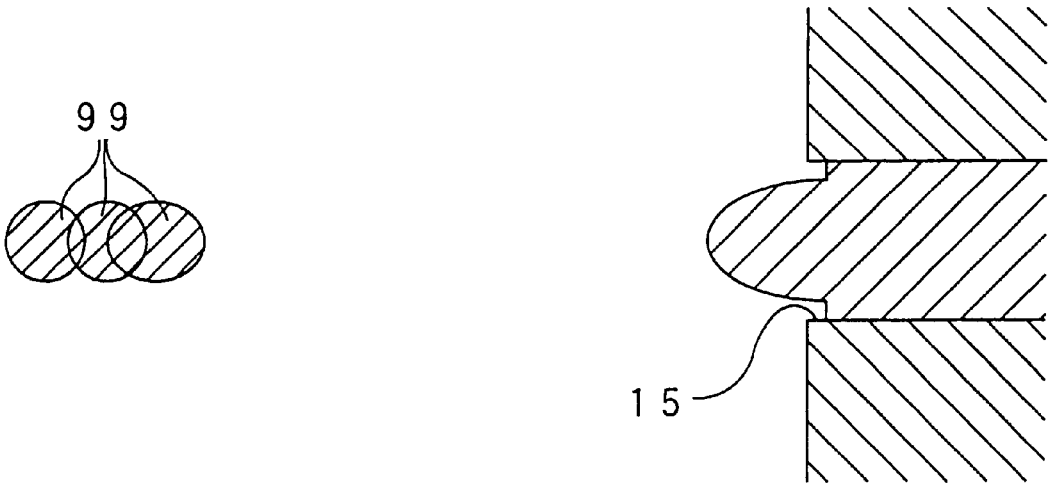
FIG.9B RELATED ART
FIG. 9B shows ink ejection when the conventional drive voltage waveform is applied.

In this embodiment, T1, T2, T3, W1, and W2 are set in ranges indicated in the above expressions according to the sequence data. Thus, the ink droplets 99 ejected from the nozzle 15 do not coalesce into a globule along the trajectory as shown in FIG. 9A, thereby preferably improving printing quality. In addition, as such coalescence can be stably prevented, the nozzle 15 is not affected by the previous ink ejection or ink ejection by an adjacent nozzle 15, thereby preferably and stably improving printing quality. Further, it is not necessary to insert a non-ejection pulse between the drive pulses, as has been conventional. Therefore, the embodiment provides high-speed printing.

On condition that T1=T, W2=2.0T, T2=T3, experiments to find optimum ranges of W1, T2 and T3 were conducted by printing various test patterns while changing values of W1, T2 and T3 while maintaining a controlled environment. The printing quality results are shown in Table 1 below. Ink used for the experiments is a water-base ink having a viscosity 3.4 mPaes and a surface tension of 33 mN/m at a specified temperature.

In Table 1, O indicates that preferable printing was obtained. X indicates that a dot was not formed at a desired position because of a deviation in the trajectory occurred or a dot was not appropriately formed because a satellite droplet (excess ink droplet subsequent to the ink droplets 99) was ejected.

TABLE 1

| | | T2 = T3 | | | | |
|---|---|---|---|---|---|---|
| | | 0.2T | 0.4T | 0.6T | 0.8T | 1.0T |
| W1 | 2.0T | X | X | X | X | X |
| | 2.2T | X | O | X | X | X |
| | 2.4T | X | O | O | X | X |
| | 2.6T | X | O | O | O | X |
| | 2.8T | X | X | O | O | X |
| | 3.0T | X | X | X | X | X |

Similar results were obtained when 0.8T≦T1≦1.2T and 1.8T≦W2 ≦2.2T. Therefore, as shown in Table 1, preferable printing quality was obtained in the following ranges:

$$0.8T \leqq T1 \leqq 1.2T,\ 0.4T \leqq T2 = T3 \leqq 0.8T,\ 2.2T \leqq W1 \leqq 2.8T,$$
$$1.8T \leqq W2 \leqq 2.2T,\ W1 > W2, \text{ and } W1 > 2T.$$

In this case, it is thought that, as T2 and T3 are set shorter than the one-way propagation time T and W1 is set longer than 2T, the first ink droplet ejection can not have any adverse effect upon the second and third ink droplets, thereby reducing the pressure applied to the ink during the ejection of the second and third ink droplets. However, preferable printing quality was not obtained outside the defined ranges.

Experiments to find optimum ranges of T1, T2, and T3 were conducted by changing ambient temperatures in stages. The values of W1 and W2 were left unchanged as with the above experiments of Table 1.

Table 2 provides a summary of experimental results. O indicates that ink droplets were stably ejected and high density printing quality was obtained. Δ indicates that ink droplets were stably ejected but printing was of a slightly inferior quality due to density. X indicates ink ejection was unstable, i.e., a deviation in the trajectory occurred or a satellite droplet was ejected.

Therefore, as shown in Table 2, preferable printing quality was obtained over a wide range of temperatures in ranges indicated by the following expressions:

$$0.8T \leqq T1 \leqq 1.2T,\ 0.4T \leqq T2 \leqq 1.2T,\ 0.4T \leqq T3 \leqq 0.8T,\ T1 \geqq T2 \geqq T3,$$
$$2.2T \leqq W1 \leqq 2.8T,\ 1.8T \leqq W2 \leqq 2.2T,\ W1 > W2, \text{ and } W1 > 2T.$$

Figure 8B:
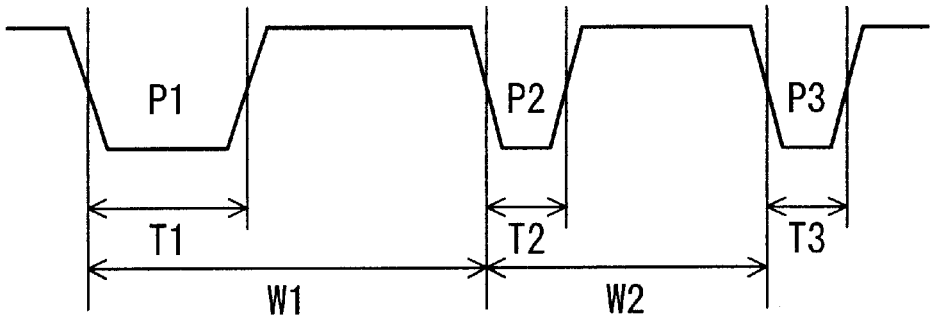
FIG. 8B is a drive voltage waveform of a drive voltage applied to the piezoelectric actuator.

It should be understood that the invention is not limited in its application to the details of structure and the arrangement of parts illustrated in the accompanying drawings. The invention is capable of other embodiments and of being practiced or performed in various ways without departing from the technical idea thereof, based on existing and well-known techniques among those skilled in the art. For example, the above embodiment uses rectangular waveforms, however, a trapezoidal waveform can be used. In this case, values of T1, T2, T3, W1 and W2 may be set with respect to a center of each of the oblique lines of the trapezoidal waveform, as shown in FIG. 8B. The invention can be applied to a case where four or more ink droplets are ejected. In addition, after the three ink droplets are ejected, a non-ejection pulse to suppress fluctuations of the pressure can be applied to reduce a cycle of the print command, thereby further facilitating high-speed printing.

Figure 8C:
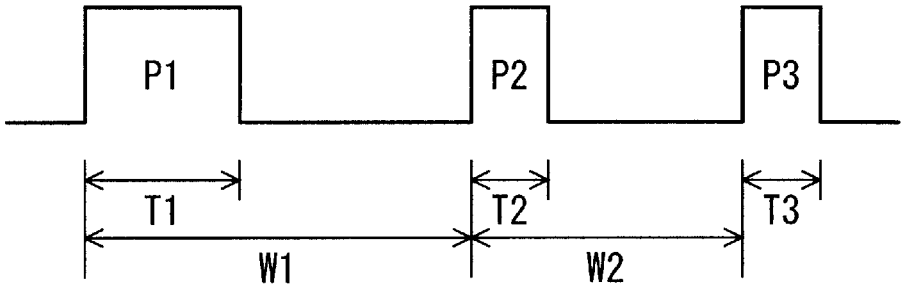
FIG. 8C is a drive voltage waveform of a drive voltage applied to the piezoelectric actuator.
Figure 8D:
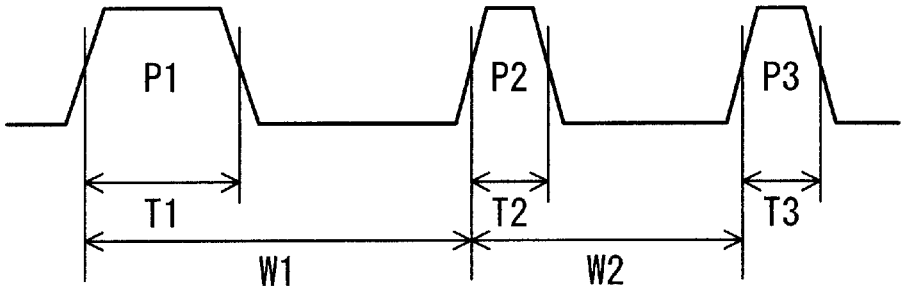
FIG. 8D is a drive voltage waveform of a drive voltage applied to the piezoelectric actuator.
Figure 8E:
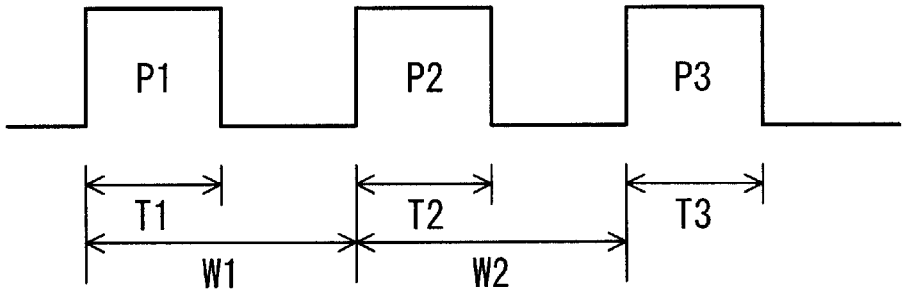
RELATED ART FIG.8E
FIG. 8E is a conventional drive voltage waveform of a drive voltage applied to the piezoelectric actuator.
Figure 10A:
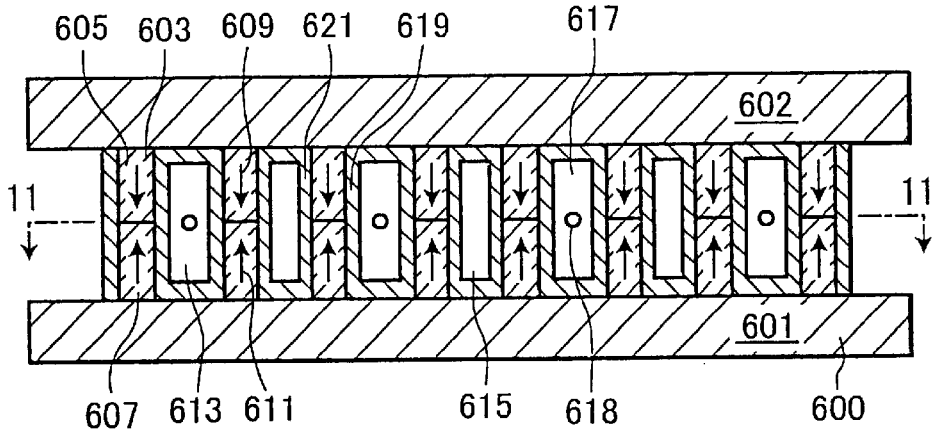
FIG. 10A is a sectional view taken along line 10—10 of FIG. 10B, which shows a structure of the ink jet apparatus of the invention (and the related art)
Figure 10B:
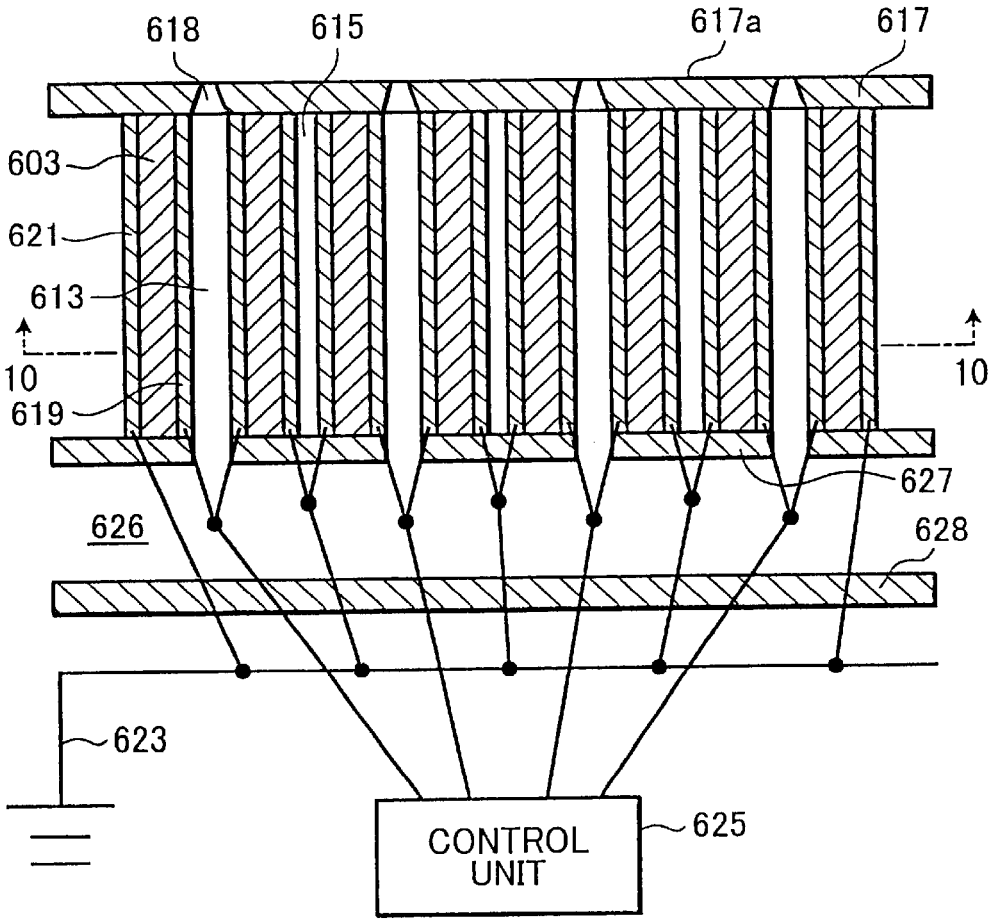
FIG. 10B is a sectional view taken along line 11—11 of FIG. 10A.
Figure 11:
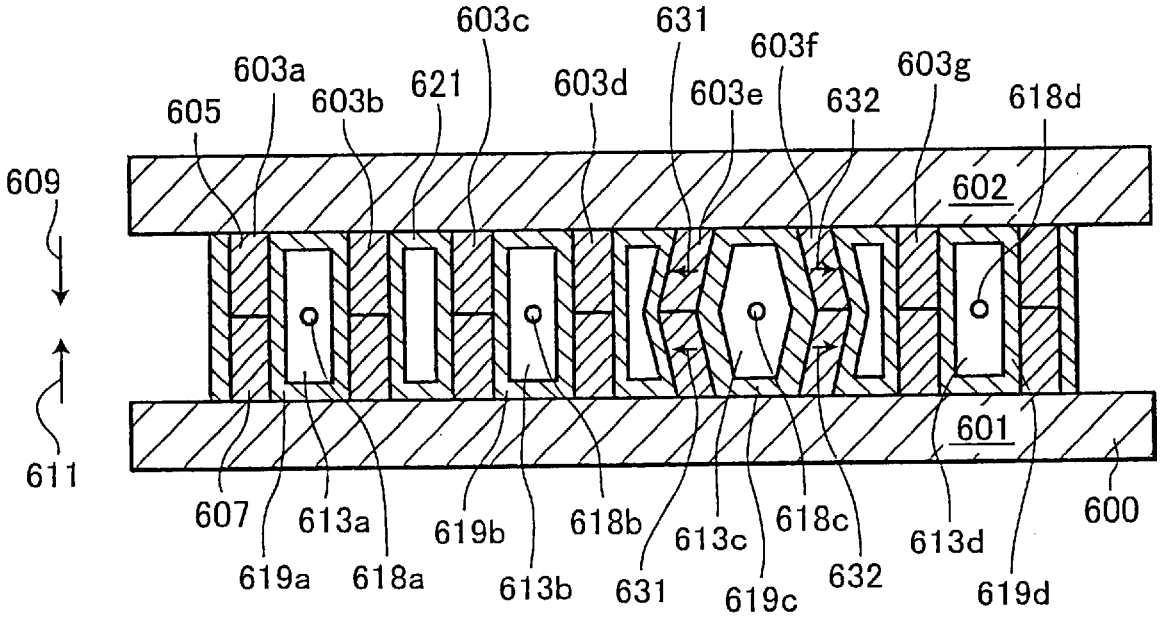
FIG. 11 shows an example of an operation of the ink ejection apparatus shown in FIGS. 10A and 10B.

In the above embodiment, the ink jet printer head is constructed by lamination of the cavity plate 10 and the piezoelectric actuator 20. However, the invention can be applied to an ink ejection apparatus wherein side walls of an ink chamber are made up of the piezoelectric element as shown in the related art of FIGS. 10A, 10B, and 11, for example, disclosed in U.S. application Ser. No. 09/069,777 corresponding to Japanese Laid-Open Patent Publication No. 10-296975. In this case, drive waveforms, such as shown in FIGS. 8C and 8D are used.

In the above embodiment, the actuator is formed of the piezoelectric elements. However, the actuator may be formed of another medium as long as it can provide positive and negative pressure wave fluctuations within the ink in the ink chamber through the application of a drive pulse.

What is claimed is:

1. An ink ejection apparatus, comprising:

a nozzle from which ink is ejected;

an ink chamber provided on a back of the nozzle where the ink is stored;

an actuator that changes a volume of the ink chamber; and a drive device that drives the actuator by applying a drive signal including a plurality of pulses to the actuator to cause the actuator to generate a pressure wave vibration in the ink chamber, thereby ejecting three or more separate ink droplets from the nozzle, wherein the drive

TABLE 2

| PULSE | | | | | | | | | | |
|---|---|---|---|---|---|---|---|---|---|---|
| T1 | 1.4 T | 1.2 T | 1.0 T | 1.0 T | 1.0 T | 1.0 T | 0.8 T | 0.8 T | 0.8 T | 0.6 T |
| T2 | 1.4 T | 1.2 T | 1.0 T | 0.8 T | 0.6 T | 0.6 T | 1.0 T | 0.8 T | 0.6 T | 0.4 T |
| T3 | 0.8 T | 0.8 T | 0.6 T | 0.6 T | 0.6 T | 0.8 T | 0.6 T | 0.8 T | 0.4 T | 0.2 T |
| TEMP | | | | | | | | | | |
| 5° C. | X | Δ | Δ | X | Δ | X | X | X | X | X |
| 10° C. | X | Δ | Δ | Δ | ○ | X | X | X | Δ | X |
| 15° C. | X | ○ | ○ | Δ | ○ | X | X | X | Δ | X |
| 20° C. | X | ○ | ○ | ○ | Δ | X | Δ | X | ○ | X |
| 25° C. | X | ○ | ○ | ○ | Δ | X | ○ | X | ○ | X |
| 30° C. | X | ○ | ○ | ○ | Δ | X | Δ | X | ○ | X |
| 35° C. | X | ○ | ○ | ○ | X | X | X | X | Δ | X |
| 40° C. | X | Δ | ○ | ○ | X | X | X | X | Δ | X |

device generates positive and negative pressure waves in the ink chamber through application of each drive pulse to the actuator; and, when the three or more ink droplets are ejected for one printing command and when a crest value of a voltage applied to drive pulses P1, P2 and P3 is substantially fixed, the drive signal satisfies following expressions:

$$0.8T \leqq T1 \leqq 1.2T,\ 0.4T \leqq T2 \leqq 1.2T,\ 0.4T \leqq T3 \leqq 0.8T,\ W1 > W2, \text{ and } W1 > 2T,$$

T1 is an effective pulse width of a drive pulse P1 to eject a first ink droplet, T2 is an effective pulse width of a drive pulse P2 to eject a second ink droplet, T3 is an effective pulse width of a drive pulse P3 to eject a third ink droplet, W1 is an interval between a start of the drive pulses P1 and P2, W2 is an interval between a start of the drive pulses P2 and P3, and T is a one-way propagation speed where a pressure wave is propagated in the ink chamber once.

2. The ink ejection apparatus according to claim 1, wherein T2, T3, W1 and W2 satisfy the following expressions:

$$0.4T \leqq T2 = T3 \leqq 0.8T,\ 1.8T \leqq W2 \leqq 2.2T, \text{ and } 2.2T \leqq W1 \leqq 2.8T.$$

3. The ink ejection apparatus according to claim 1, wherein T1, T2 and T3 satisfy T1≧T2>T3.

4. The ink ejection apparatus according to claim 1, wherein the actuator is made of a piezoelectric element.

5. The ink ejection apparatus according to claim 4, wherein at least one side wall of the ink chamber is the actuator made of the piezoelectric element.

6. The ink ejection apparatus according to claim 5, wherein the ink chamber includes the actuator of the piezoelectric element on both side walls thereof.

7. The ink ejection apparatus according to claim 1, wherein the actuator receives a drive pulse to first increase and then decrease the volume of the ink chamber, causing ink to be ejected from the nozzle.

8. The ink ejection apparatus according to claim 1, wherein the drive pulse applied to the actuator by the drive device is a voltage pulse.

9. The ink ejection apparatus according to claim 1, wherein the plurality of pulses have a rectangular waveform.

10. The ink ejection apparatus according to claim 1, wherein the plurality of pulses have a trapezoidal waveform and the start of the drive pulses is a center of a lead oblique line of the trapezoidal waveform.

11. A method for controlling ink ejection from a nozzle of an ink ejection print head, comprising the steps of:

breaking a print command into at least three drive pulses to eject at least three separate ink droplets;

establishing a pulse width for each drive pulse; and establishing a time interval between the drive pulses, wherein:

$$0.8T \leqq T1 \leqq 1.2T,\ 0.4T \leqq T2 \leqq 1.2T,\ 0.4T \leqq T3 \leqq 0.8T,\ W1 > W2, \text{ and } W1 > 2T,$$

wherein T1 is an effective pulse width of a first drive pulse to eject a first ink droplet, T2 is an effective pulse width of a second drive pulse to eject a second ink droplet, T3 is an effective pulse width of a third drive pulse to eject a third ink droplet, W1 is an interval between a start of the first and second drive pulses, W2 is an interval between a start of the second and third drive pulses, and T is a one-way propagation speed where a pressure wave is propagated in the ink chamber once.

12. The method according to claim 11, further comprising a step of fixing a crest voltage for the first, second and third drive pulses.

13. The method according to claim 11, further comprising the step of phasing in a voltage and phasing out the voltage for each drive pulse to define a trapezoidal wave form.

14. The method according to claim 11, wherein T2, T3, W1 and W2 satisfy the following expressions:

$$0.4T \leqq T2 = T3 \leqq 0.8T,\ 1.8T \leqq W2 \leqq 2.2T, \text{ and } 2.2T \leqq W1 \leqq 2.8T.$$

15. The method according to claim 11, wherein T1, T2 and T3 satisfy T1≧T2>T3.

16. The method according to claim 11, wherein the plurality of pulses have a rectangular waveform.

17. The method according to claim 11, wherein the plurality of pulses have a trapezoidal waveform and the start of the drive pulses is a center of a lead oblique line of the trapezoidal waveform.

* * * * *